US005211582A

United States Patent [19]

Morse et al.

[11] Patent Number: 5,211,582

[45] Date of Patent: May 18, 1993

[54] REPAIRABLE CONNECTOR

[75] Inventors: Ronald W. Morse, Sidney; Douglas M. Johnescu, Gilbertsville, both of N.Y.

[73] Assignee: Amphenol Corporation, Wallingford, Conn.

[21] Appl. No.: 848,337

[22] Filed: Mar. 9, 1992

[51] Int. Cl.[5] ..... H01R 13/40

[52] U.S. Cl. ..... 439/589; 439/598

[58] Field of Search ..... 439/587-589, 439/598, 902, 903

[56] References Cited

U.S. PATENT DOCUMENTS

| | | | |
|---|---|---|---|
| 2,740,098 | 3/1956 | Phillips | 439/589 |
| 2,841,635 | 7/1958 | Witzell et al. | 174/77 |
| 3,444,507 | 5/1969 | Gerhard | 339/100 |
| 3,922,477 | 11/1975 | Glowacz | 174/18 |
| 3,945,700 | 3/1976 | Didier | 439/589 |
| 4,072,154 | 2/1978 | Anderson et al. | 128/419 P |
| 4,167,300 | 9/1979 | Fischer et al. | 339/94 C |
| 4,180,301 | 12/1979 | Hutter | 339/90 C |
| 4,385,792 | 5/1983 | Bauer et al. | 339/36 |
| 4,402,566 | 9/1983 | Powell et al. | 439/589 |
| 4,746,310 | 5/1988 | Morse et al. | 439/620 |
| 4,941,349 | 7/1990 | Walkow et al. | 439/589 |
| 4,981,446 | 1/1991 | Lazaro, Jr. et al. | 439/589 |

*Primary Examiner*—Paula A. Bradley

*Attorney, Agent, or Firm*—Bacon & Thomas

[57] ABSTRACT

An electrical connector is made repairable by providing a front insert which is removable from and retained in the shell by an O-ring. The shell includes an undercut in which the O-ring is mounted, and the insert includes a circumferential elliptical groove. In use, as the insert assembly is inserted into the shell, the O-ring mounted on the undercut of the shell is compressed by the insert until it reaches the groove, whereupon it expands into the groove in a direction parallel to the direction of insertion, which constitutes the major axis of the elliptical profile of the groove, and thus provides positive retention and sealing without the need for additional retention mechanisms. Removal is facilitated by a removal tool which includes hooks extending from a front circumference of a sleeve of the removal tool. The hooks are inserted through slots in the insert and past a collar provided around the mating interface of the insert. The tool is then rotated a short distance to cause the hooks to engage a back surface of the collar, while a piston provides a biasing force to lock the insert against the connector during removal.

11 Claims, 4 Drawing Sheets

REPAIRABLE CONNECTOR

BACKGROUND OF THE INVENTION

1. Field of the Invention

This invention relates to connectors in which components of the connector can be removed for repair or replacement by removing an insert of the connector.

2. Description of Related Art

Recently, a variety of connectors have been developed in which it is possible for the user to remove individual contacts or filter/transient suppression assemblies for repair or replacement in the field, using simple manually operated tools. An example of a repairable transient suppression connector is disclosed in U.S. Pat. No. 4,746,310 (Morse et al.), assigned to Amphenol Corporation. In order to remove the transient suppression components, a removable front insert is provided which, upon removal, affords access to the interior components and enables selective removal of individual transient suppression contact assemblies. The transient suppression contact assemblies each carry a diode which may be replaced without having to replace all of the transient suppression components at once. The insert in the Morse et al. connector is threaded into the connector shell, facilitating removal and yet providing very secure retention of the insert when it is assembled to the connector shell.

The use of a threaded front insert is not possible, however, in certain types of transient voltage suppression and/or filter connectors. For example, the SJT connector, which includes both filters and transient suppression contacts and incorporates features of the scoop proof MIL-C-38999 series I connector into a series II connector, has an extended front interface wall section of specified configuration which is too thin to be threaded and therefore does not allow for the use of a threaded insert. Thus, it has heretofore been impossible to provide an SJT connector which can easily be repaired in the field by manually removing the front insert, despite the advantages that would be possessed by such a connector. The arrangement disclosed by Morse et al. has heretofore also been impossible to implement in connectors which require non-cylindrical front inserts, such as the rectangular ARINC connector. Non-cylindrical connector shells cannot be threaded.

Any removable front insert arrangement for standardized connectors such as the SJT or ARINC connectors must meet three requirements:

1. The insert must be easily removable from the connector shell and yet readily assembled to the connector shell;

2. The insert, when assembled into the connector, must be held securely by the connector shell so as not to unintentionally expose the contents of connector; and 3. Provision for the insert must not require modification of the shell interface, for example by requiring external latches which would interfere with operation of the connector.

In contexts other than connectors, it has previously been proposed to employ frictional locks instead of threading, i.e., locks in which direct engagement between the insert and a housing, or indirect engagement via an additional friction member, is used to secure the insert within the housing. However, the possibility of using a frictional lock in a connector has never been appreciated, primarily because of the necessity of securing the insert within the connector shell when in use.

Frictional locks, such as the one disclosed in U.S. Pat. No. 2,841,635 (Witzell), have previously been used only in situations in which a minimum holding force is required, or in conjunction with an additional locking mechanism.

The device disclosed in Witzell is noteworthy because the frictional lock disclosed therein is an O-ring seal which serves to hold a cable coupler cover against movement in one direction relative to a shell when the coupler is not mated with another shell. However, movement in the direction in which tension is likely to be applied is prevented by a separate latch, and thus Witzell-type frictional locks do not appear to be suitable for the purpose of electrical connector insert retention, at least as disclosed in Witzell.

In the context of connector front inserts, O-ring seals have of course long been used, but solely for sealing purposes. For example, the connector of Morse et al. uses an O-ring seal in connection with the above-described removable insert retention arrangement, but does not in any way suggest, explicitly, or implicitly, that the O-ring could be arranged to serve as a Witzell-type frictional lock.

The present invention lies in the recognition that, by suitable modification of an electrical connector shell and insert, the O-rings conventionally used as seals between the connector shell and the front insert could also be used to retain the front insert in the connector without affecting the interface, and nevertheless provide a retention force sufficient for all applications of the connector, thus making possible for the first time field repairable SJT-type connectors, as well as field repairable non-cylindrical transient suppression and filter connectors.

SUMMARY OF THE INVENTION

In view of the advantages of providing repairability for electrical connectors, and the previous impossibility of doing so for certain types of connectors, it is a principal objective of the invention to provide a front insert retention arrangement which is suitable for use in all electrical connectors, including electrical connectors which do not allow for insert retention by threading, without adding to the complexity of the connector or requiring significant modification of the interface portion of the connector.

This objective is achieved, according to one preferred embodiment of the invention, by providing a connector having a front insert which is retained solely by an O-ring sealing member. Retention is accomplished by providing an interior O-ring retention undercut or groove in the connector shell and an exterior O-ring receiving groove in the insert, the grooves being arranged such that during insertion the O-ring, which is held captive by the shell undercut, is compressed against an annular collar provided on the insert until the collar passes the O-ring and the O-ring snaps into or is captured by the groove to thereby retain the insert in the shell.

The force which retains the insert in the shell is significantly increased by the provision of an elliptical O-ring receiving groove which causes the O-ring to compress radially and expand axially into the groove as the insert is assembled to the connector. When the O-ring expands into the groove, the expanding O-ring pulls the insert with it until the groove and O-ring are aligned. Subsequently, when the insert is moved by a short distance which is insufficient to cause the O-ring to escape the elliptical groove, the O-ring recompresses and the consequent re-expansion pulls the insert back into position.

Achievement of the principal objective of the invention is further facilitated by the provision of a unique insert removal tool which enables removal of the insert from an otherwise inaccessible position. The removal tool includes a cylindrical main body and a shell in which resides a piston biased in the direction of insertion, and which includes on its front circumference hook members for engaging a portion of the insert to enable withdrawal of the insert from the shell. The shell is removably attached to the main body to enable the tool to be used with different insert configurations.

DETAILED DESCRIPTION OF THE PREFERRED EMBODIMENT

Figure 1:
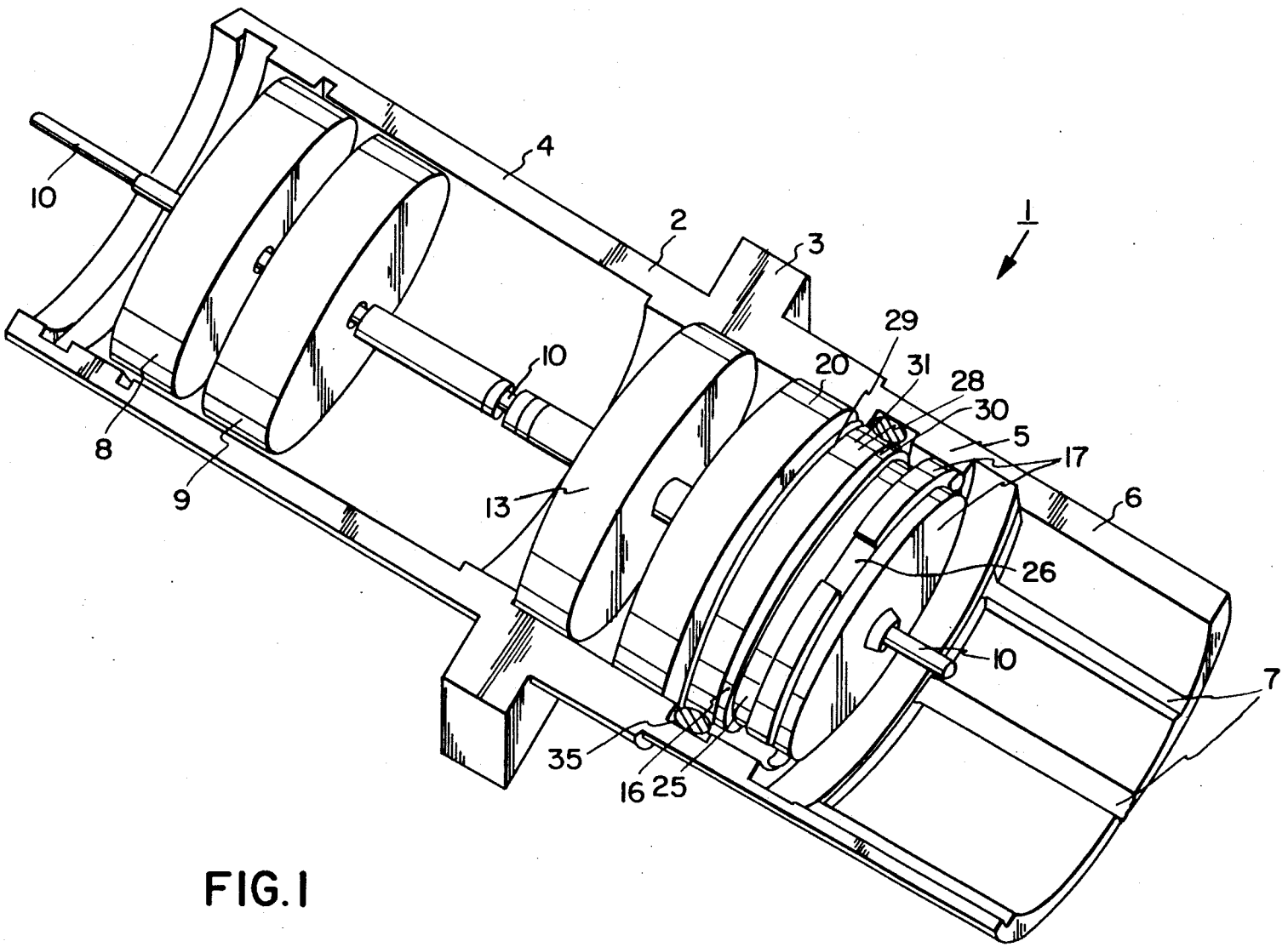
FIG. 1 is a partially cross-sectional perspective view of an SJT connector constructed in accordance with the principles of a preferred embodiment of the invention.
Figure 2:
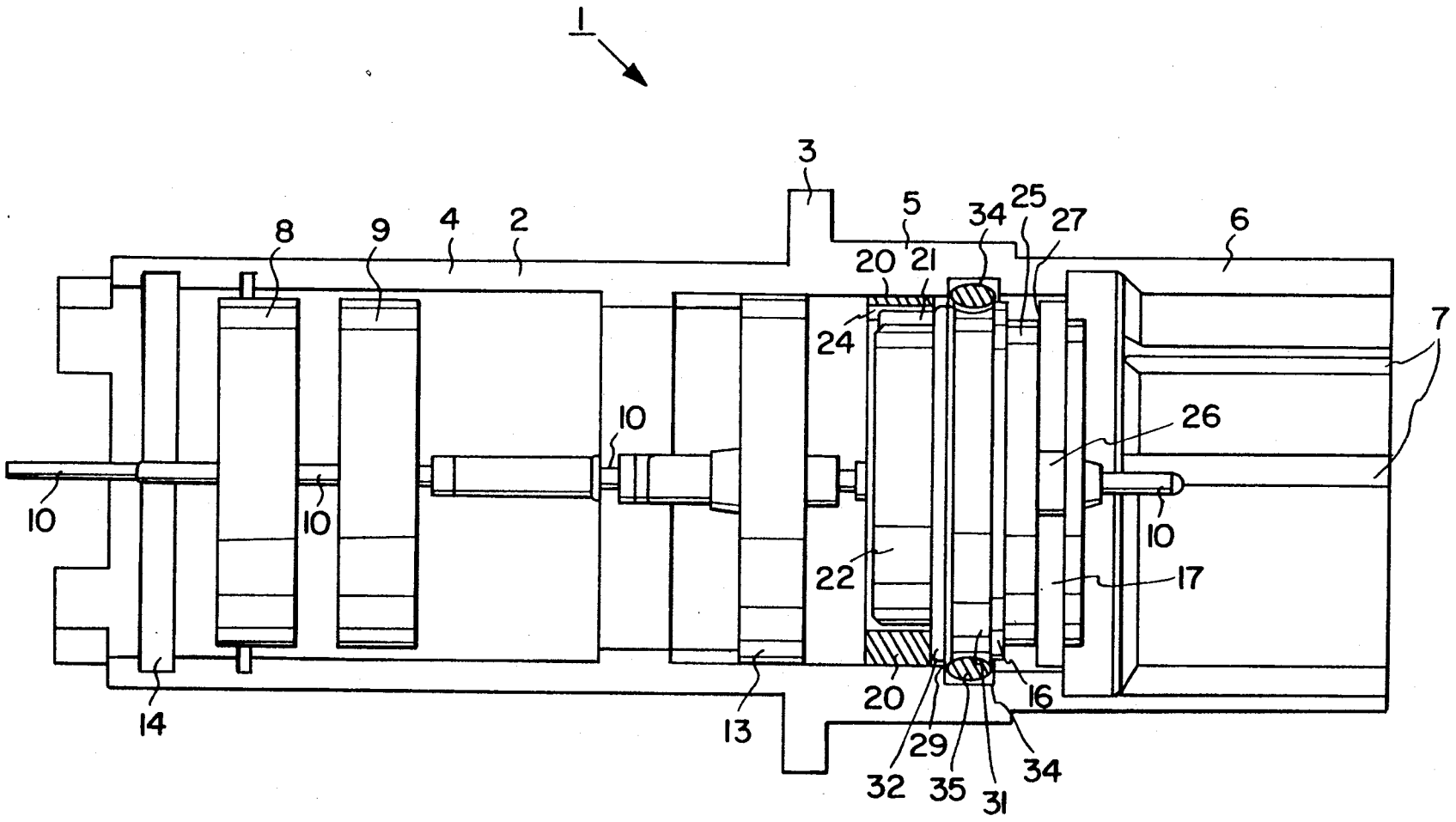
FIG. 2 is a partially cross-sectional side view of the connector of FIG. 1.
Figure 4:
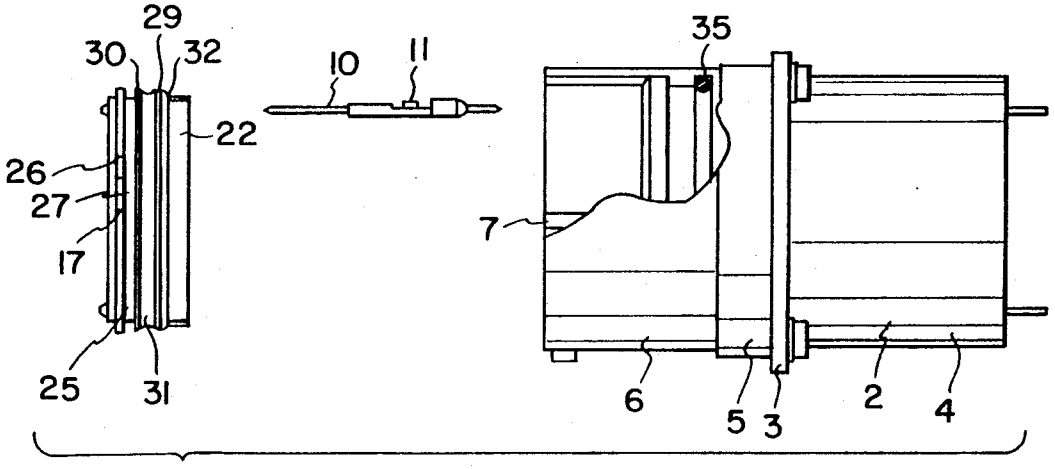
FIG. 4 is a partially cut-away side view of the connector of FIG. 1, with the front insert and a contact removed.
Figure 3:
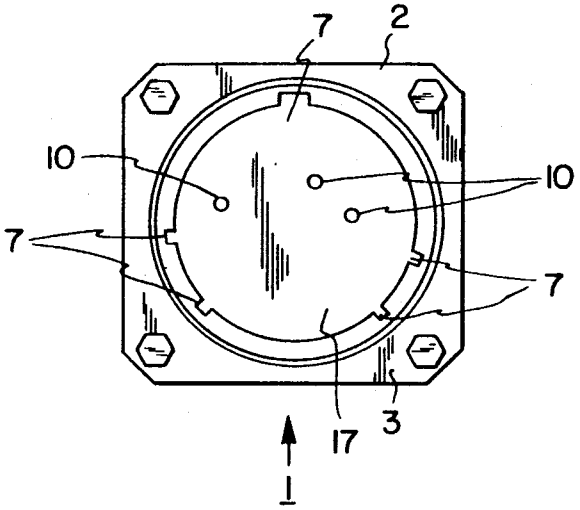
FIG. 3 is a front end view of the connector of FIG. 1.

FIGS. 1–4 illustrate an SJT connector arranged to permit removal of individual contact assemblies for repair or replacement using a simple hand-held manual tool. Because of the relative thinness of the mating interface of this connector, a conventional threaded insert cannot be used to facilitate removal. Therefore, a unique insert retention arrangement has been provided. Nevertheless, the preferred insert retention arrangement does not require alteration of any other components of the connector, all of which are conventional except as noted below.

Those skilled in the art will appreciate that the principles of the invention may be extended to numerous types of electrical connectors other than the illustrated SJT connector. For example, the inventive insert retention arrangement will find particular applicability in rectangular and other non-cylindrical connectors.

The standard features of the SJT connector illustrated in FIGS. 1–4 are as follows:

SJT connector 1 includes a shell 2 made of a conductive or conductively plated material. Shell 2 includes a panel mounting flange 3, to the rear of which is a cylindrical main body portion 4, and at the front of which is an insert retention section 5 and an interface section 6. Interface section 6 is designed to mate with a corresponding interface section on a second SJT connector (not shown), the interface section on the second connector being designed to fit within section 6. Section 6 includes key grooves 7 for engaging projecting portions on the second connector to align the second connector with the first connector. Housed within the rear portion 4 of shell 2 are a pair of capacitor filter assemblies 8 and 9 and a plurality of contacts 10, only one of which is shown. Each contact 10 includes a separate transient suppression component 11.

In the illustrated connector, the transient suppression components carried by the contacts are diodes, which may be located in a notch in the contact or which may be provided in the form of a discrete component having leads designed to mate with contact halves. Component 11 may also be a multi-layer varistor or other transient suppression component. Surrounding component 11 is a ground sleeve or cylindrical lead which is designed to contact a molded and conductively plated ground plate structure 13 in the manner disclosed in, for example, U.S. Pat. No. 4,746,310, incorporated herein by reference.

The contacts extend through a thermally conductive epoxy member 14 for the purpose of being secured to conductors of a cable or to individual wires provided in an electrical device to which the connector is mounted. The front portions of contacts 10 pass through a front insert 16 which provides a planar mating interface portion 17 from which the contacts extend to engage corresponding contacts on the second connector (not shown). In order to properly mate with the second connector, the portions of connector 1 which engage the second connector are standardized.

Details of the components provided in rear portion 4 of connector 1, and details of the mating interface, are well known to those skilled in the art and therefore are not described in further detail herein.

The inventive front insert retention arrangement is as follows:

Front insert 16 is generally cylindrical in shape, and has an outside diameter which is slightly smaller than the inside diameter of section 5 of shell 2. Within the shell is provided an annular press ring 20 having at least one slot 24 which cooperates with an alignment key 21 on a rear portion 22 of front insert 16. The key prevents complete insertion of the insert into the shell unless the key and slot 24 in press ring 20 are aligned. When key 21 is positioned in slot 24, engagement of the key with the slot prevents rotation of the insert.

Behind planar mating interface portion 17 is a circumferential tool insertion groove 25. Additional slots 26 are provided which extend through planar mating interface portion 17 to permit insertion of an extension in the form of a hook on the insert removal tool, described in more detail below, to cause the hook to engage a wall 27 of groove 25 forming a back surface of interface portion 17, and thereby permit the user to withdraw the insert as the removal tool is withdrawn. Between groove 25 and rear portion 22 is a circumferential projection 28 formed by two collars 29 and 30 which form an O-ring receiving groove 31 therebetween. Collar 29 includes a beveled surface 32 to facilitate insertion of the insert past the O-ring during assembly.

In addition to modifying the conventional insert assembly in order to achieve the preferred retention arrangement by providing groove 31 as described above, it is also necessary to provide in the interior surface of shell 2 an O-ring retention groove or undercut 34. O-ring retention groove or undercut 34 must be large enough to accommodate and retain a suitably sized O-ring 35, and is located opposite the position occupied by groove 31 when front insert 16 is fully assembled into the shell. Before assembly, O-ring 35 is located in groove 34. Front insert 16 is then pushed into shell 2 until collar 29 passes O-ring 35 and snaps into groove 31 while still held captive in groove 34. It has been found that use of a conventional O-ring is sufficient to prevent disengagement of the insert from the connector under all forces to which the insert is likely to be subject during use. In addition, O-ring 35 provides a sealing function for sealing the interior of the connector against moisture and environmental contaminants.

Groove 31 preferably has an elliptical profile arranged to cause lateral compression of the O-ring upon assembly of the insert into the connector, thus increasing the retention effect by making axial recompression of the O-ring, i.e., recompression in the direction of insertion parallel to an axis of the connector shell, more difficult. This effect is achieved by orienting the major axis of the elliptical profile in a direction parallel to the direction of insertion, and by making the minor axis short enough that the O-ring is compressed in the direction transverse to the direction of insertion. The parallel expansion of the O-ring in the groove tends to pull the insert into the shell once collar 29 has passed the O-ring during assembly. Any force sufficient to pull on the insert by an amount which recompresses the O-ring, but which is insufficient to cause the O-ring to escape its capture by groove 32, will be opposed by the tendency of the O-ring to reexpand into the groove. This causes the surprising effect that when the insert is pulled by a small distance in the direction of removal, and then let go, the insert appears to move by itself back into its assembled position. Thus, the use of an elliptical groove profile greatly increases the insert retention effect of the arrangement.

It will of course be appreciated by those skilled in the art that the preferred insertion retention arrangement could also be used for a rear or side insert in an electrical connector, and that the O-ring retention groove may be provided on the insert itself rather than on the inside surface of the connector shell, with the O-ring receiving groove provided in that case in the connector shell, the O-ring being removable with the insert rather than remaining at all times in the shell. Also, the groove need not be formed in a single continuous piece of material, but rather may be defined by two or more adjacent pieces.

Figure 5:
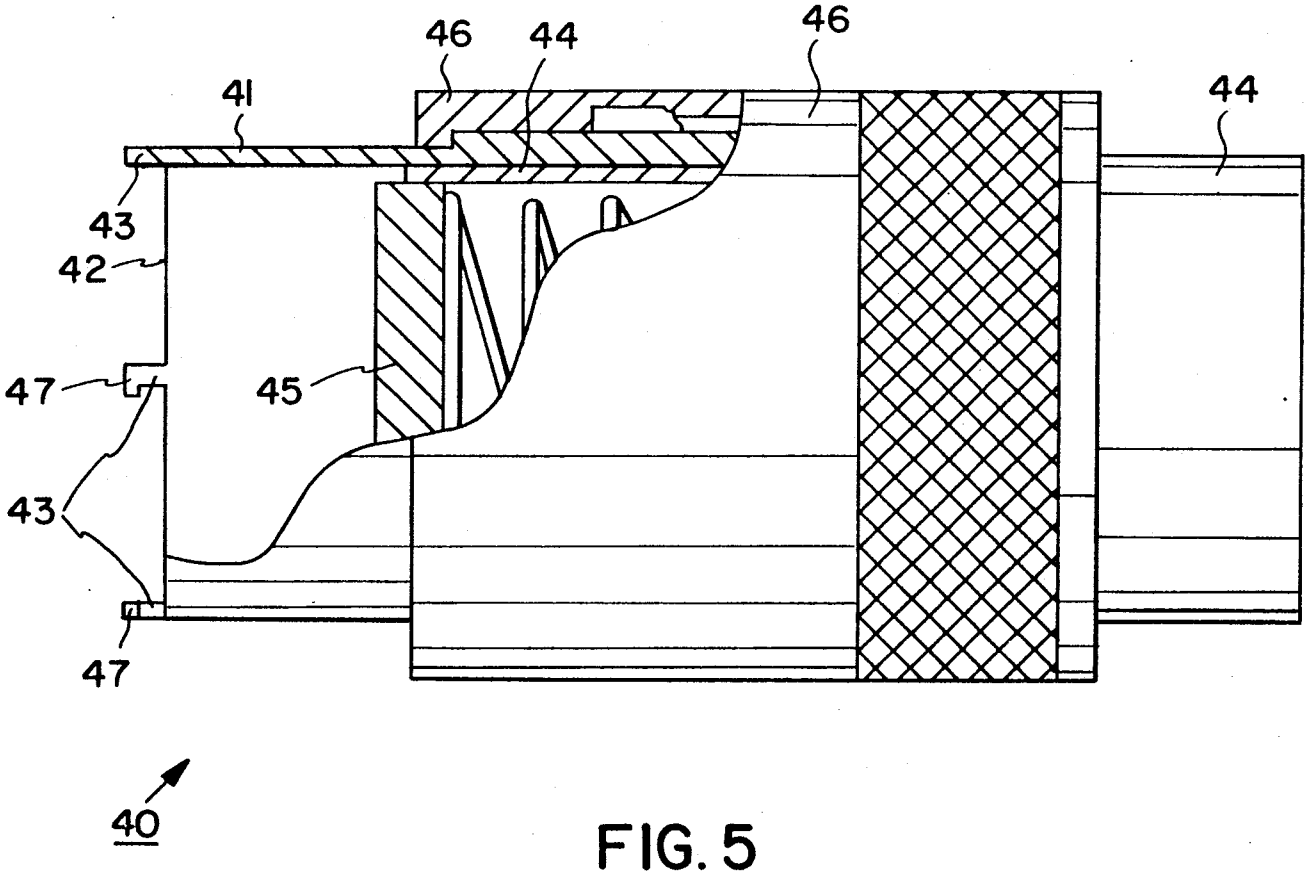
FIG. 5 is a partially cut-away side view of an insert removal tool constructed in accordance with the principles of the preferred embodiment of the invention.

FIG. 5 shows an SJT insert removal tool 40 which is part of the preferred retention arrangement of the invention. Removal tool 40 includes a sleeve 41 having a cylindrical front portion 42 from which extends four L-shaped hooks 43 for engaging wall 27 of groove 25 after they have passed through slots 26 in interface portion 17 of front insert 16. The sleeve body is preferably bolted to a main body 44 so that it may be replaced with sleeves of different sizes. Main body 44 includes a spring/plunger piston 45 for applying gripping force to insert 16. Collar 46 is threaded to the sleeve or body and provides leverage to assist the user in pulling the insert out past the O-ring interference.

Assembly and disassembly of the front insert into and from the connector shell is accomplished as follows:

In order to assemble the front insert into the connector, the insert is aligned with the contacts of the connector and key 21 is aligned with slot 24. The insert is then pushed by hand or with the back of tool 40 into the connector shell. Tool 40 preferably includes an undercut to provide clearance for the pin contacts. When collar 29 passes O-ring 35 and the O-ring expands into groove 32, assembly is complete.

To remove the insert, hooks 43 are aligned with and pushed through tool slots 26. The tool is then rotated such that circumferentially extending portions 47 engage the rear wall 27 of the front mating interface. At this time, piston 45 is in a compressed condition against the ends of the pin contacts or the socket insert. Seating the collar 46 tightly against the front face of the shell 2, the collar 46 is turned so that the mechanical advantage of the threaded main body 44 pulls the front insert 16 axially to overcome the resistance of the O-ring 35. The tool may then be withdrawn from the connector shell together with the insert after overcoming the resistance provided by O-ring 35. At this time, the contacts may be removed by a conventional contact removal tool of the type which includes a cylindrical sleeve that is caused to extend over the contact and disengage from the contact a plurality of resilient contact retention tines extending from the ground plate or another insert.

Having thus described in detail a retention arrangement which is specially suited for use in retaining a front insert in a connector, and an SJT type connector which is repairable, it should nevertheless be appreciated that numerous variations are possible within the scope of the invention. Consequently, it is intended that the invention not be limited by the above description, but rather that it be limited solely by the appended claims.

We claim:

1. A repairable electrical connector, comprising:

a connector shell;

at least one electrical contact for carrying electrical signals from conductors in a second connector mated at one end of said connector to electrical conductors on the other side of the connector;

an insert assembly which fits within said one end of the connector and substantially within the connector shell, and which is removable from said connector shell to permit removal of said at least one contact from said connector;

an O-ring;

a first groove extending around the insert assembly and a second groove extending around an inside surface of said connector shell, wherein one of said first and second grooves is arranged to retain said O-ring therein during assembly of the insert into the connector shell and removal of the insert from the connector shell, and wherein the other of said first and second grooves is arranged to receive said O-ring only when the insert is assembled into the connector shell to retain the insert in the connector, whereby said O-ring serves to both retain said insert substantially within said connector shell and also to provide a seal between said insert and said connector shell.

2. A connector as claimed in claim 1, wherein said first groove has an elliptical profile in a direction parallel to the direction of insertion, whereby when said O-ring is captured by said first groove, the O-ring is compressed in a direction transverse to the direction of insertion and expands in said parallel direction, removal of said insert requiring recompression of the O-ring in the transverse direction.

3. A connector as claimed in claim 1, where said first groove is the groove arranged to receive said O-ring only when the insert is assembled into the connector shell.

4. A connector as claimed in claim 3, wherein said first groove is defined by two collars surrounding a perimeter of said insert, and wherein one of said collars includes means defining a beveled surface for facilitating movement of said first collar past said O-ring during insertion.

5. A connector as claimed in claim 1, further comprising a third groove arranged to receive an insert removal tool, said third groove being defined by a surface, said surface being part of a mating interface portion of said insert, the mating interface portion including means defining a slot through which an extension on the removal tool may be passed to permit said extension to engage said surface during removal of the insert from the connector.

6. A connector as claimed in claim 1, wherein said insert further comprises a key and said connector includes a press fit ring having means defining a key slot for receiving said key to align said insert with respect to said connector shell.

7. A connector as claimed in claim 1, wherein said contacts are transient suppression contacts.

8. A removable insert assembly for an electrical connector, comprising means defining at least one aperture in said insert assembly for receiving an electrical contact, and means defining a groove extending around a perimeter of the insert assembly for receiving an O-ring when the insert assembly is inserted into a connector shell such that the O-ring retains the insert assembly in the connector shell, wherein said groove has an elliptical profile in a direction of insertion, whereby when said O-ring is captured by said first groove, the O-ring is compressed in a direction transverse to the direction of insertion and expands in a direction parallel to the direction of insertion of said insert into the connector shell, removal of said insert requiring recompression of the O-ring in the transverse direction.

9. A connector as claimed in claim 8, wherein said groove is defined by two collars surrounding a perimeter of said insert, and wherein one of said collars includes means defining a beveled surface for facilitating movement of said first collar past said O-ring during insertion.

10. A connector as claimed in claim 8, further comprising an additional groove arranged to receive an insert removal tool, said additional groove including a surface, said surface being part of a mating interface portion of said insert, said interface portion including means defining a slot through which an extension on the removal tool passes to engage said surface during removal of the insert from the connector.

11. A frictional lock for a coupler, comprising:

a shell;

an insert assembly which fits within the shell;

an O-ring;

a first groove extending around the insert assembly and a second groove extending around an inside surface of said connector shell, wherein one of said first and second grooves is arranged to retain said O-ring therein during assembly of the insert assembly into the shell and removal of the insert assembly from the shell, wherein the other of said first and second grooves is arranged to receive said O-ring only when the insert assembly is assembled into the shell to retain the insert in the shell, and wherein said other of said first and second grooves has an elliptical profile in the direction parallel to the direction of insertion, whereby when said O-ring is received by said other groove, the O-ring is compressed in a direction transverse to the direction of insertion and expands in the parallel direction, and whereby, as a result, removal of the insert requires application of a force in the parallel direction to recompress the O-ring in the transverse direction.

* * * * *